United States Patent [19]

Wunner

[11] Patent Number: 4,872,323

[45] **Date of Patent: * Oct. 10, 1989**

[54] APPARATUS FOR LAYING TRANSVERSE WEFT THREADS FOR A WARP KNITTING MACHINE

[75] Inventor: Roland Wunner, Schwarzenbach/Wald, Fed. Rep. of Germany

[73] Assignee: LIBA Maschinenfabrik GmbH, Fed. Rep. of Germany

[ * ] Notice: The portion of the term of this patent subsequent to Jul. 7, 2006 has been disclaimed.

[21] Appl. No.: 70,013

[22] Filed: Jul. 6, 1987

Related U.S. Application Data

[63] Continuation of Ser. No. 860,699, May 5, 1986, Pat. No. 4,677,831, which is a continuation of Ser. No. 674,648, Nov. 26, 1984, abandoned.

[30] Foreign Application Priority Data

Nov. 28, 1983 [DE] Fed. Rep. of Germany ..... 3343048

[51] Int. Cl.[4] ..... D04B 23/06

[52] U.S. Cl. ..... 66/84 A; 66/190; 66/192; 66/196; 28/100

[58] Field of Search ..... 66/84 A, 85 A, 190, 66/191, 192, 193, 196; 28/100; 156/439, 440

[56] References Cited

U.S. PATENT DOCUMENTS

| | | | |
|---|---|---|---|
| 3,665,732 | 5/1972 | Doring et al. | 66/84 A |
| 3,756,043 | 9/1973 | Kemter | 66/84 A |
| 4,080,232 | 3/1978 | Friedich | 28/101 X |
| 4,325,999 | 4/1982 | Campman et al. | 156/181 |
| 4,380,913 | 4/1983 | Wilkens | 66/84 A |
| 4,395,888 | 8/1983 | Wilkens | 66/84 A |
| 4,484,459 | 11/1984 | Hutson | 66/84 A |
| 4,556,440 | 12/1985 | Krueger | 156/181 |

FOREIGN PATENT DOCUMENTS

| | | | |
|---|---|---|---|
| 316742 | 11/1969 | Sweden | 28/100 |

*Primary Examiner*—Ronald Feldbaum
*Attorney, Agent, or Firm*—Anthony A. O'Brien

[57] ABSTRACT

An apparatus for laying groups of transverse weft threads for a warp knitting machine, the threads being laid on two longitudinal conveyors running to the needle bed by means of a carriage which is reciprocated between and transversely to the direction of travel of the longitudinal conveyors. The weft threads laid after the forward movement lie parallel to the weft threads laid after the backward movement and with the same spacing from the adjacent weft thread in each case. First groups of weft threads are laid as a first layer and then groups of weft threads are laid as a second layer on the first layer in a direction of their weft threads which forms, with the direction of the weft threads of the first layer, and angle, particularly of at least 20°, which opens transversely to the direction of travel of the longitudinal conveyors.

8 Claims, 7 Drawing Sheets

APPARATUS FOR LAYING TRANSVERSE WEFT THREADS FOR A WARP KNITTING MACHINE

Figure 19:
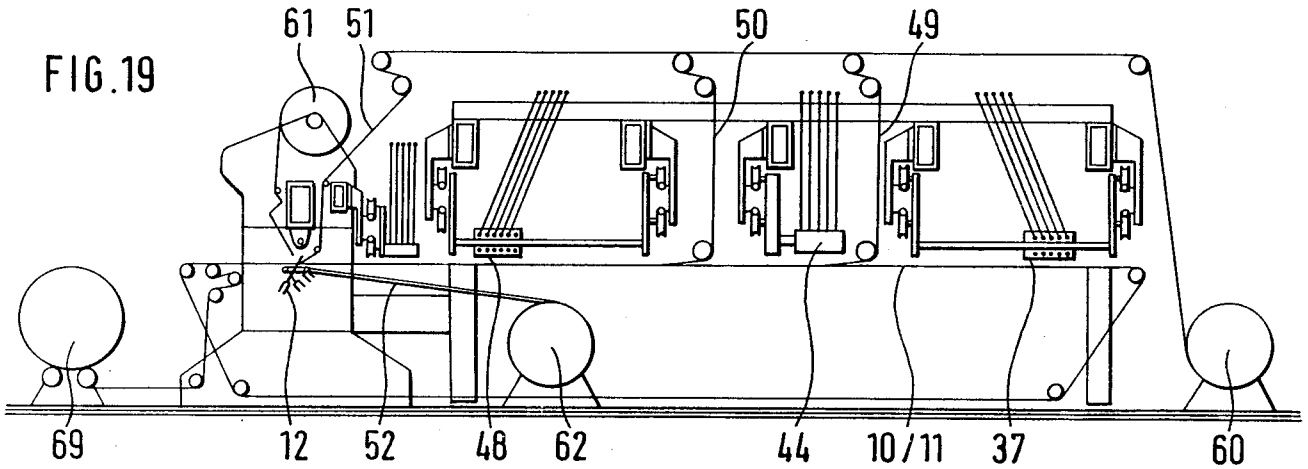

This is a continuation of Ser. No. 860,699, filed 5/5/86 now U.S. Pat. No. 4,677,831, which is a continuation of parent appliation Ser. No. 674,648 filed Nov. 26, 1984 (now abandoned).

SUBJECT OF THE INVENTION

This invention relates to a method of, and apparatus for, laying and conveying transverse weft threads in a warp knitting machine.

DISCUSSION OF THE PRIOR ART

In a known method of laying large numbers of transverse weft threads for a warp knitting machine, the threads are laid on two longitudinal conveyors, each movable toward the needle bed, by means of a carriage, which is reciprocated between and transversely to the direction of travel of the longitudinal conveyors, to form a layer of transverse weft threads, a plurality of layers being laid in succession, of which one layer is laid with such a parallel structure that the weft threads laid by the forward movement of the carriage lie parallel to the weft threads laid by the return movement and equally spaced from the adjacent weft thread.

A weft-thread laying apparatus which works in the manner outlined above is known from the DE-OS 20 13 694. In this apparatus, a carriage is provided which is moved between the longitudinal conveyors, perpendicular to their direction of travel, and on which a plurality of thread guides are disposed, each of which lays a large number of threads both during the forward movement and during the return movement of the carriage, transversely to the direction of travel of the longitudinal conveyors. In this case, the one thread guide for the one layer is rigidly secured to the carriage and therefore lays its large numbers of threads in a zigzag (cross weft) pattern as a result of the forward movement of the longitudinal conveyors, the consequence of which is that a number of weft threads overlap additional reciprocating movement of the thred guide by the same carriage contains a large numbers of transverse weft threads laid in the same parallel structure, always perpendicular to the direction of conveying of the longitudinal conveyors, so that the weft threads laid after the forward movement lie parallel to the weft threads laid after the return movement and to the previously laid adjacent weft thread, with equal spacing, which is attributable to a corresponding displacement of the thread guide in the direction of or counter to the direction of travel of the longitudinal conveyors. The goods produced in this manner have an uneven structure as a result of the said overlapping. In addition, only a relative small angle between the weft threads of the one layer laid in a zigzag pattern and the weft threads of another layer said perpendicular to the direction of travel can be achieved with this apparatus because this angle is determined by the length of the thread guide mounted fixed to the carriage in relation to the width of the goods, which length cannot be selected arbitrarily.

A further weft-thread laying apparatus is known from the DE-OS 20 65 911. In this apparatus, a layer of weft threads is laid between the longitudinal conveyors by means of the carriage moved perpendicular to the direction of travel of the longitudinal conveyors, within which layer the individual weft threads lie parallel to one another with equal spacing, namely perpendicular to the direction of travel of the continuously running longitudinal conveyors. In this case, in order to ensure the same perpendicular alignment of the weft threads in relation to the direction of travel, despite the continuous running of the longitudinal conveyors, a thread guide mounted on the reciprocated carriage and guiding a large number of threads is displaced, during the carriage movement, along a guide rail extending obliquely to the carriage movement so that the thread guide moves in a path that is oblique relative to the path of the carriage as it moves with reference to the machine frame, during the reciprocating movement of the carriage. At the end of each carriage movement, the thread guide is then set back into an initial position outside the longitudinal conveyors, whereby the group of threads guided by the thread guide is inserted in the longitudinal conveyor in question beside the group of threads previously laid. The layer of weft threads consisting of the groups of threads laid side by side is then conveyed by means of the longitudinal conveyors to the needle bed of the warp knitting machine where the individual weft threads are knitted in so that a knitted article with transverse weft threads results.

A further weft-thread laying apparatus for a warp knitting machine is known from the DE-OS 20 12 114, which likewise works with continuously running longitudinal conveyors and a carriage moved perpendicular to the direction of travel of the longitudinal conveyors. In this apparatus, the individual weft threads lie perpendicular to the direction of travel of the continuously running longitudinal conveyors and parallel to one another with equal spacing. The running of the longitudinal conveyors is here taken into consideration, for the purpose of perpendicular alignment of the weft threads, in that, at the end of each carriage movement, the threads of the group in question are taken over, outside the longitudinal conveyors, by a displacement comb which, as a result of a displacement movement extending counter to the direction of travel of the longitudinal conveyors, lays the threads of this group in the longitudinal conveyor in question so that the required equal spacing apart of all the threads results.

A weft-thread laying apparatus with a plurality of thread guides is also known, namely from the DE-OS 25 19 834, wherein each thread guide can only lay a single weft thread, and can do so either perpendicular to the direction of travel of the longitudinal conveyors or in zigzag form obliquely in relation to the direction of travel, the latter mode of operation being brought about because that the thread guides are moved appropriately slowly in relation to the travelling speed of the longitudinal conveyors. With this method of operation, it is also important that the thread laid by a thread guide during the forward movement of the thread guide extends in a different direction from that laid during the return movement in each case, namely in a zigzag as stated, so that the condition laid down at the beginning cannot be fulfilled, that the weft threads laid after the forward movement lie parallel to the weft threads laid after the return movement. To this extent, the weft-thread laying apparatus in question is not in a position, in the case of zigzag guiding of the weft threads, to lay layers of weft threads in which the weft threads lie parallel to one another with equal spacing. In addition, the same apparatus suffers from the disadvantage that it can only work with a low travelling speed of the longitudinal conveyors because there are limits on the speed of the reciprocated thread guides. For this reason, in connection with high speed warp knitting machines, only those weft-thread laying arrangements have gained acceptance which lay a large number of weft threads at a time, usually about 10 to 20 weft threads per group.

OBJECT OF THE INVENTION

It is the object of the invention to increase considerably the loading capacity of knitware with weft threads thus worked in.

STATEMENT OF METHODS OF THE INVENTION

According to the invention, in a method of laying transverse weft threads as outlined above, a second layer of threads is laid on the first layer, in a parallel structure, by means of a further carriage, with the same parallel structure as the first layer but with the direction of its weft threads altered in relation to the first layer so that the direction of the weft threads of the first layer forms, with the direction of the weft threads of the second layer, define angle, of at least about 20°, which opens transversely to the direction of travel of the longitudinal conveyors.

As a result of the provision of two layers of weft threads which are independent of one another and which extend at the given angle to one another and transversely to the direction of travel, while the continuous parallel guiding of the weft threads in question is retained within each layer, with constant spacing, the goods thus formed have particularly high strength with regard to the displacement of the individual layers in relation to one another with regard to their angle, so that the article is particularly resistant over a wide range of tensile directions. In addition, the article has a high resistance to further tearing after being damaged. What is decisive, as the essence of the invention, first laying the first layer of weft threads and then laying the second layer of weft threads on the first layer, so that a uniform product results over the whole area, which product has the same special loop pattern at every point and the same construction in the thickness direction of the knitwear.

For the selection of the directions of the two layers, there is the possibility of allowing one of the two layers to extend substantially perpendicular to the direction of travel of the longitudinal conveyors, with the outer layer extending obliquely to this direction of travel. On the other hand, both layers may be laid so that they cross the direction of travel of the two longitudinal conveyors at substantially the same angle, particularly at 45°. In the latter case, a symmetrical construction results which provides a knitted article which can be heavily loaded and which can be used particularly universally.

A particular increase in the loading capacity of the goods can be achieved in that a third layer of weft threads is laid, the direction of the weft threads of which extends substantially perpendicular to the direction of travel of the longitudinal conveyors and the first and second layer practically enclose the third layer symmetrically with regard to their angle.

The third layer may appropriately be laid between the first and second layers, that is to say, the third layer is laid after the laying of the first layer and before the laying of the second layer.

In order to achieve as uniform an inner structuring of the goods as possible, all the layers may appropriately be formed so that the spacing of the weft threads is uniform.

A further increase in the loading capacity, particularly in the direction of travel of the longitudinal conveyors, is obtained if stationary threads extending in the direction of travel of the longitudinal conveyors are introduced over one layer, particularly between two layers.

In order to give the goods a greater density or fullness, a flat textile formation (for example a web of fleece or a prefabricated article) may be introduced over or under a layer, particularly between two layers which then gives the goods a special internal structure which is desired in each case.

STATEMENT OF APPARATUS OF THE INVENTION

The invention further relates to a weft-thread laying apparatus for warp knitting machines for carrying out the method steps described above, wherein the weft threads are conveyed so the needle bed by means of two longitudinal conveyors and a layer of weft threads is laid by means of a carriage which is displaceable transversely to the direction of travel of the longitudinal conveyors and which lays a large number of weft threads from one longitudinal conveyor to the other by means of a thread guide which is disposed on the carriage and is possibly adjustable on this in the direction of travel, a plurality of layers being laid in succession. Such a weft-thread laying apparatus is described in the first of the prior documents mentioned above, DE-OS 20 13 694.

The weft-thread laying apparatus, working by the method steps of the invention explained above, is characterised in that one carriage with thread guide is provided per layer, the carriages being spaced apart in the direction of travel of the longitudinal conveyors with the paths of movement of their thread guides extending at such an angle to one another that the direction of the weft threads of the first layer forms, with the direction of the weft threads of the second layer, an angle, particularly of at least about 20°, which opens transversely to the direction of travel of the longitudinal conveyor.

The carriage provided for the laying of the third layer may then appropriately be arranged between the carriages laying the first and second layers so that the layer laid by the third carriage is disposed between the first and second layers.

In order to be able to make the particular width of the goods selective, the path of movement of the carriages may appropriately be made adjustable with regard to the path length.

As a result of an adjustability of the extent of the displacement of at least one thread guide, an appropriate adjustment of the angle at which the weft threads of the layer in question extend to the direction of travel of the longitudinal conveyors is obtained. The greater the displacement of the thread guide, the more the direction of the weft threads in question deviates from the perpendicular to the direction of travel of the longitudinal conveyors. This adjustability of the extent of displacement of the thread guide can naturally be provided for each carriage.

SCHEDULE OF THE DRAWINGS

Figure 1:
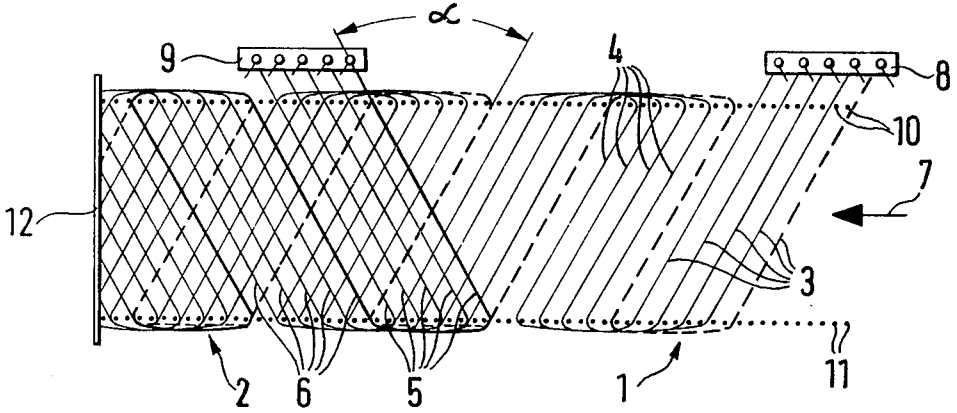
Figure 2:
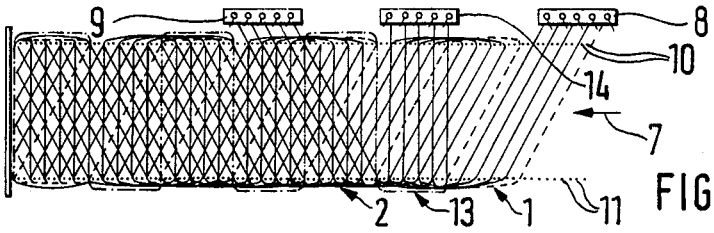
Figure 3:
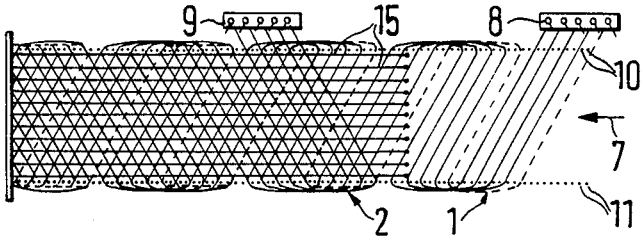
Figure 4:
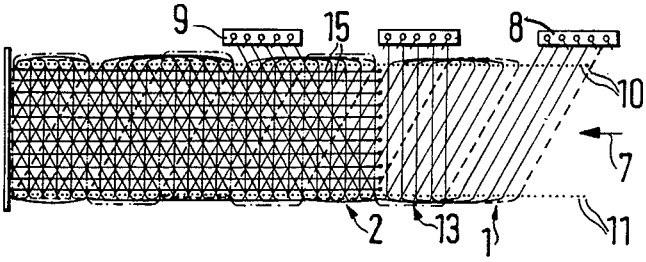
Figure 5:
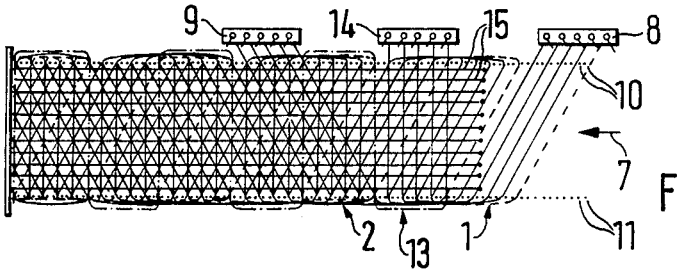
Figure 6:
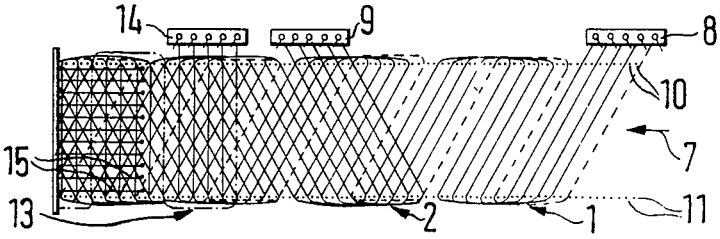
Figure 14:
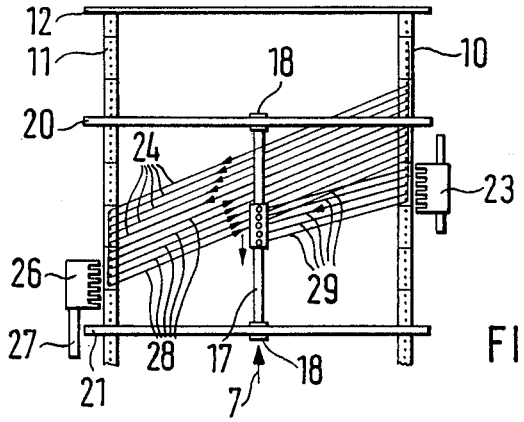
Figure 15:
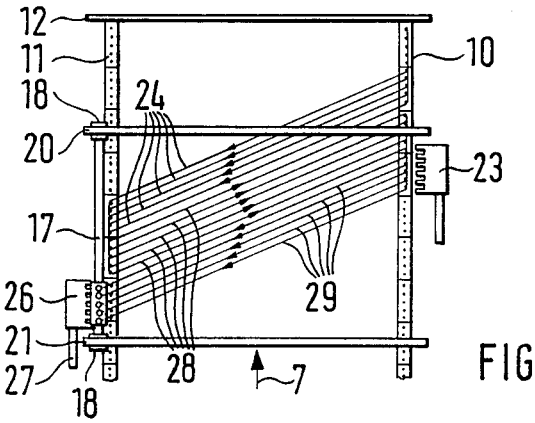
Figure 16:
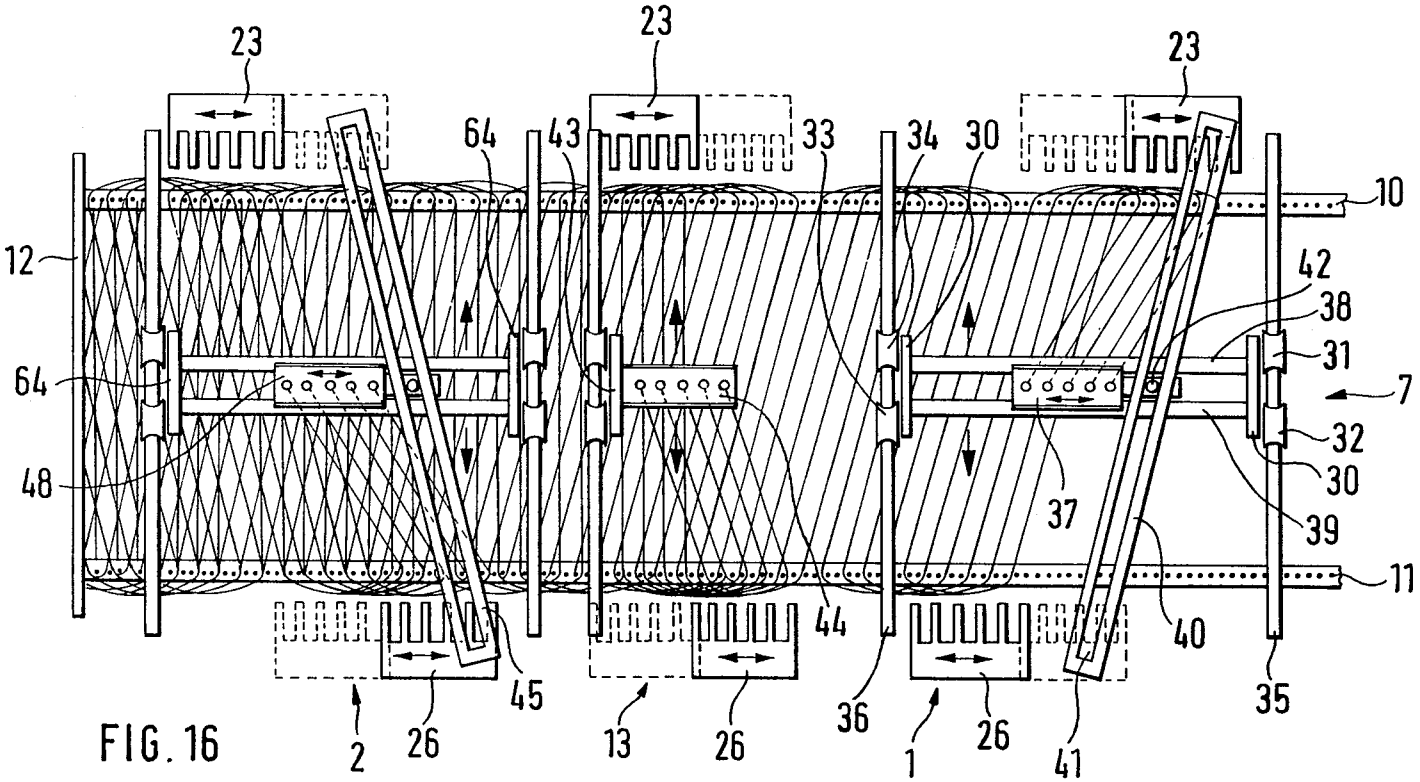
Figure 17:
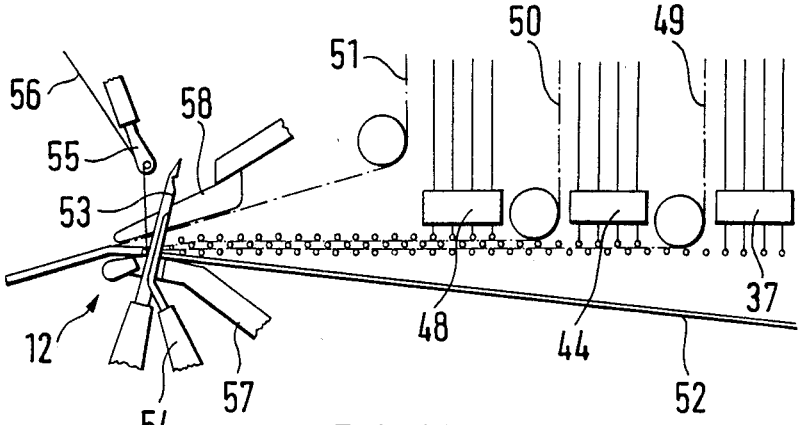
Figure 18:
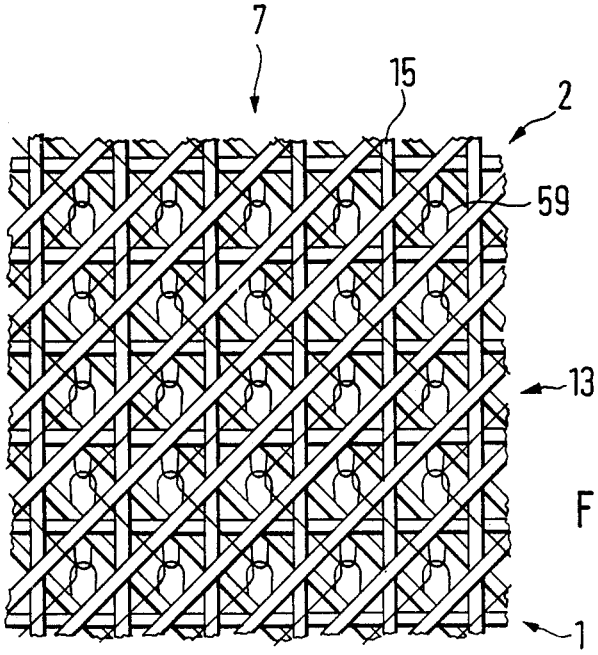

An embodiment of the invention is illustrated, by way of example, on the accompanying drawings, in which:

FIG. 1 shows, illustrated in principle, two layers of transvese weft threads which are to be conveyed to a needle bed and which each extend symmetrically transversely to the direction of travel of the longitudinal conveyors, at an angle of about 30°, FIG. 2 shows the diagrammatic illustration of the laying of three layers, the middle one of which extends perpendicular to the direction of travel of the conveyors, FIG. 3 shows the diagrammatic illustration of two layers, as in FIG. 1, but with stationary threads entering between the two layers, FIG. 4 shows the diagrammatic illustration of three layers, as in FIG. 2, but with stationary threads entering between the upper and middle layers, FIG. 5 shows the diagrammatic illustration of three layers, as in FIG. 2, but with stationary threads entering between the bottom and middle layers, FIG. 6 shows the diagrammatic illustration of three layers, the two bottom ones of which extend as in FIG. 1, and laid on these is a layer which extends perpendicular to the direction of travel of the longitudinal conveyors and on which additional stationary threads are laid, FIGS. 7–15 show the individual phases in the laying of groups of threads in one layer, which extend substantially at an angle of 25° to transverse to the direction of travel of the longitudinal conveyors, FIG. 16 shows the laying of three layers, as in FIG. 2, using displacement combs, FIG. 17 shows a cross-section through the basic construction of a warp knitting machine with an apparatus for laying three layers of weft threads as well as for introducing stationary threads and a fleece, FIG. 18 shows the loop pattern which results with the layer formation as shown in FIG. 4, and FIG. 19 shows, illustrated in principle, the whole side view of a warp knitting machine with the apparatus for laying weft threads, and for introducing stationary threads, and a web of fleece.

DESCRIPTION OF THE INVENTION WITH REFERENCE TO THE DRAWINGS

Illustrated diagrammatically in FIG. 1 are two layers 1 and 2 of transverse weft threads, each of which extends at an angle of about 30° traverse to the direction of travel of longitudinal conveyors 10 and 11, indicated by the arrow 7, the conveyors here being indicated only by successive dots. A further illustration of the longitudinal conveyors is found in FIGS. 16 and 19. The arrow originating from the reference numeral 1 points in the direction of the weft threads of the layer 1 and the arrow originating from the reference numeral 2 in the direction of the weft threads of the layer 2. Each layer 1 and 2 is formed by successive groups of weft threads of which two successive groups on the right-hand side of the layer 1 are designated by the reference numerals 3 and 4 and two successive groups at the left-hand side of the layer 2 are designated by the reference numerals 5 and 6.

Each group 3, 4 or 5, 6 consists of five weft threads. Within each layer 1 or 2, all the weft threads extend parallel to one another, adjacent weft threads each having the ame spacing. It is pointed out here that normally the number of weft threads per group is greater but for reasons of simplification and clarity of the illustration, a relatively small number of weft threads per group is shown. The laying of the groups 3, 4 or 5, 6 of weft threads (and of the groups not indicated, following thereon in the direction of the arrow 7) is effected in each case by means of the thread guide 8 for the layer 1 and of the thread guide 9 for the layer 2 which thread guides are reciprocated between and beyond the longitudinal conveyors 10 and 11, which will be gone into in more detail in connection with FIG. 16. In this manner, the layer1, which is to be transported by means of the longitudinal conveyors 10, 11 to the needle bed 12, here likewise only indicated, of a warp knitting machine is first laid by means of the thread guide 8 (see FIGS. 17 and 19). Laid on the layer 1 in a corresponding manner by mans of the thread guide 9 is the layer 2 which is likewise conveyed by the longitudinal conveyors 10 and 11 to the needle bed 12, so that the two successive layers 1 and 2 are connected in the needle bed 12 by means of the warp threads worked in by the knitting tools.

Figure 7:
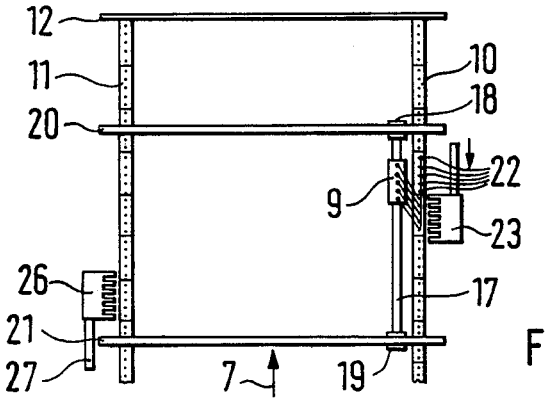
Figure 8:
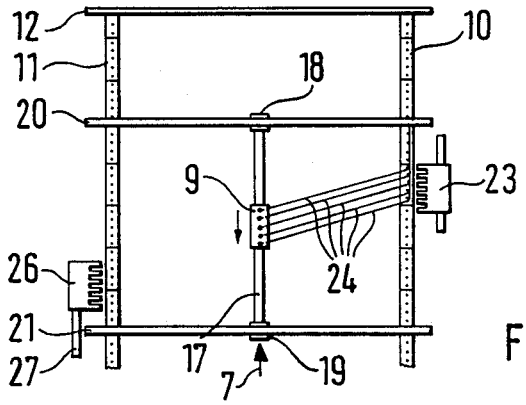

The two longtudinal conveyors 10 and 11 hold the weft threads of the individual groups 3, 4 or 5, 6 etc. in known manner by means of pins or hooks (see DE-OS 20 12 114, FIGS. 6, 7, 8). After the thread guides 8, 9 have assumed their position illustrated in FIG. 1, outside the longitudinal conveyors 10, 11, the group 3 or 5 in question of weft threads is displaced by the width of one group counter to the direction of travel of the longitudinal conveyors 10 and 11, that is to say counter to the direction of the arrow 7, as a result of which the pattern of the layers 1 and 2 illustrated in FIG. 1 results in which, as stated, the individual weft threads lie parallel to one another and adjacent weft threads have the same spacing. This displacement of the weft threads can either be effected by corresponding displacement of the thread guide 8 or 9 (see DE-OS 20 65 911) or by a displacement comb (see DE-OS 20 12 114, FIGS. 9 to 15). From FIG. 1, the displacement results from the fact that laterally, outside the two longitudinal conveyors 10 and 11, the weft threads are laid substantially parallel to the longitudinal conveyors, each weft thread over a length corresponding to the width of each group 3, 4 or 5, 6. The course of a weft thread for layer 1 or 2 can be followed as a result of the fact that one weft thread in the layer 2 is shown in continuous thick lines and one weft thread in the layer 1 is drawn in broken, thick lines.

As can be seen, with the formation of the two layers 1 and 2 of weft threads illustrated in FIG. 2, a textile structure results wherein, including the warp threads worked in, in known manner, in the needle bed 12, two different weft threads, which are nevertheless aligned symmetrically to one another, pass uniformly through the goods in question which are thus given a correspondingly high strength and loading capacity in a wide range of directions.

The structure of a knitted article illustrated in FIG. 1 with two layers of transverse weft threads, can be varied in so far as one of the two layers 1 and 2 may also extend perpendicular to the direction of travel of the two longitudinal conveyors 10 and 11, indicated by the arrow 7. In any case, an angle $\alpha$ formed by the two layers 1 and 2 results which opens transversely to the direction of travel of the longitudinal conveyors 10 and 11.

In FIGS. 2 to 6 are illustrated modifications of the basic structure of the knitted article illustrated in FIG. 1, with a plurality of layers of transverse weft threads, the simplified illustration used in FIG. 1 being retained.

According to FIG. 2, the layer 13 is added to the two layers 1 and 2 of FIG. 1, and this is done with a direction of the weft threads in question perpendicular to the direction of travel of the longitudinal conveyors 10 and 11. In this case, the arrow originating from the reference numeral 13 points in the direction of the layer in question. The layer 13 is laid by the thread guide 14. In this case, a structure of the layers 1, 2 and 13 results in which the two layers 1 and 2 enclose the layer 13 symmetrically with regard to their angle. The layer 13 is laid after the laying of the layer 1 and before the laying of the layer 2 so that the layer 13, extending perpendicular to the direction of travel of the longitudinal conveyors 10 and 11, is between the layers 1 and 2 which benefits a symmetry, desirable in many cases, in the construction of the knitwear in question.

FIG. 3 shows a further possibility of structuring a knitted article provided with a plurality of layers of transverse weft threads, wherein first the layer formation shown in FIG. 1 that is to say with layers 1 and 2, forms the basis but in addition the stationary threads 15 are introduced between the layers 1 and 2 and are distributed with the same spacing apart over the whole width of the goods. The stationary threads 15 are laid on the layer 1 after which the layer 2 is then laid on this structure. The introduction of stationary threads into knitwear is known per se (see Melliand Textilberichte 11/1982, pages 781–783).

In FIG. 4 a structure is illustrated which starts from the structure shown in FIG. 2, that is to say in which the layer 13, which extends perpendicular to the direction of travel of the longitudinal conveyors, is disposed between the two layers 1 and 2. Here, the stationary threads 15 are now introduced between the layer 13 and the layer 2.

The structure shown in FIG. 5 represents a modification of the structure shown in FIG. 4, the stationary threads 15 being introduced between the layer 1 and the layer 13.

Finally, FIG. 6 shows another modification, starting from the structure shown in FIG. 4. Here, the stationary threads 15 are introduced above the three layers 1, 2 and 13, and there is another alteration in comparison with the structure shown in FIG. 4 in so far as the layer 2 is laid on the layer 1 and is then followed by the layer 13, above which the stationary threads 15 are introduced.

The individual phases of laying a layer, which corresponds substantially to the layer 2 shown in FIG. 1, are illustrated in FIGS. 7 to 15. In this case, the individual weft threads extend at an angle of 25° to the direction of travel of the longitudinal conveyors 10 and 11, indicated by the arrow 7. The illustration in FIGS. 7 to 15 is restricted the components necessary in principle for the mode of operation, which components are shown in more detail in the further Figures, particularly FIGS. 16 and 19.

Figure 9:
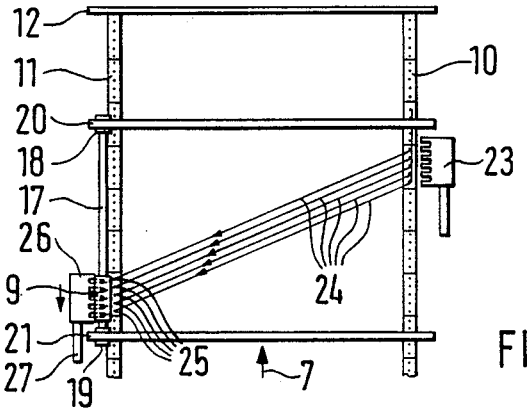
Figure 10:
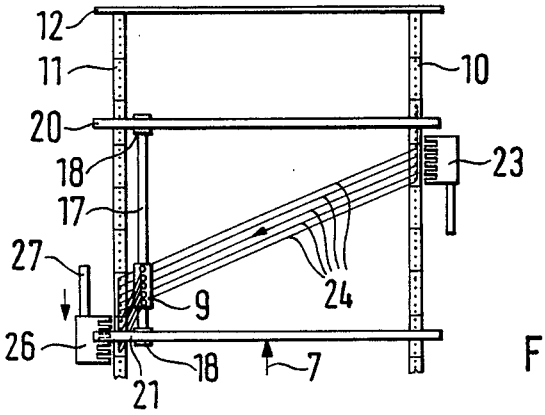
Figure 11:
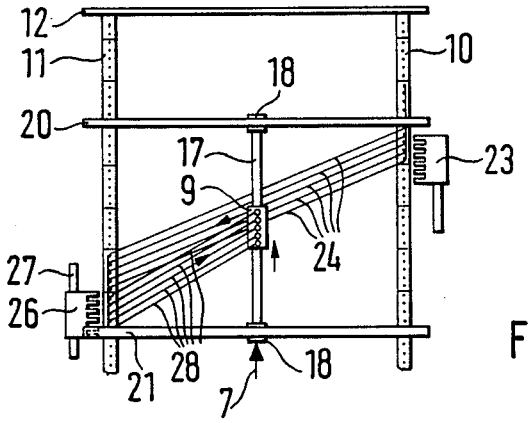
Figure 12:
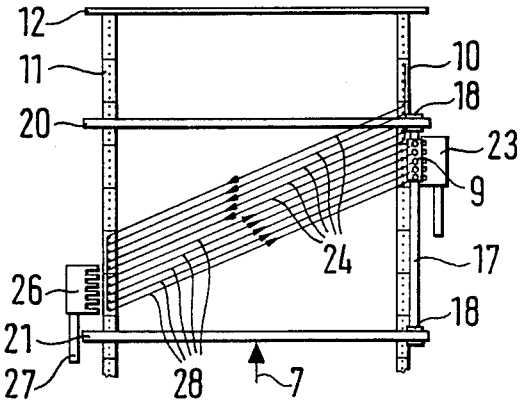
Figure 13:
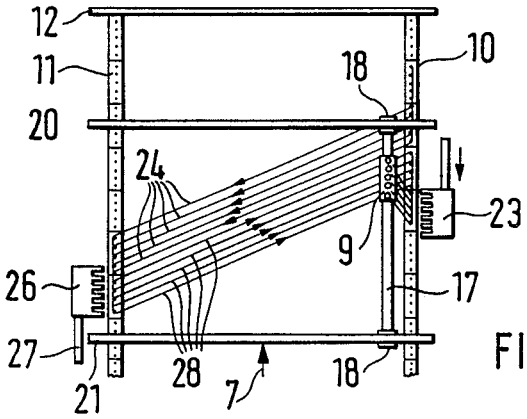

According to the FIGS. 7 to 15, illustrated above the two longitudinal conveyors 10 and 11 is the carriage 17 which is mounted for travelling along the runway rails 20 and 21 by means of the rollers 18 and 19. The carriage 17 executes a movement during which it is displaced along the runway rails 20 and 21 in a parallel position to the longitudinal conveyors 10 and 11, being stopped laterally outside the particular longitudinal conveyor 10 or 11 in each end position (see FIGS. 9 and 12). Mounted for longitudinal adjustment on the carriage 17 is the thread guide9 which, on each movement of the carriage 17, is displaced from the one longitudinal conveyor (for example 10) to the other longitudinal conveyor (for example 11), substantially over the whole length of the carriage (in positions of the thread guide 9 as shown in FIGS. 9 and 12). Such an arrangement and movement of a carriage with a thread guide is known per se (see, for example, DE-OS 20 65 911, FIG. 1). Under the two runway rails 20 and 21, the two longitudinal conveyors 10 and 11 run, in the direction of the arrow 7, to the needle bed 12. A carriage with a thread guide, illustrated in FIGS. 7 to 15, is provided for each layer of transverse weft threads to be formed, as can be seen from the FIGS. 16 and 19. The thread guide 9 receives the threads which it guides from a bobbin creel in known manner (see, for example DE-OS 20 65 911, FIG. 1).

The starting position for the laying of a layer in accordance with layer 2 of FIG. 1 is illustrated in FIG. 7. In this starting position, the weft threads of the group of threads (24 in FIG. 9) guided by the thread guide 9 are secured by their ends to the pins 22 of the longitudinal conveyor 10 and are laid, for example by hand, round the following pins (without reference numerals) and pulled through the thread guide 9. From here, as stated above, the threads then reach to a bobbin creel so that during the movement of the thread guide 9 towards the longitudinal conveyor 11, the threads run into the thread guide 9 and are laid, by the thread guide 9, over the region between longitudinal conveyor 10 and longitudinal conveyor 11. FIG. 7 shows the carriage 17 with the thread guide 9 already in a position on the way to the longitudinal conveyor 11. During this travel, the thread guide 9 comes substantially above the middle of the area enclosed by the two guide rails 20 and 21, as illustrated in FIG. 8. With the reaching of the position of the thread guide 9 illustrated in FIG. 8, the longitudinal conveyors 10 and 11 have already moved forward in the direction of the arrow 7 by half the width of the group of threads 24 laid. On its further travel, the thread guide 9 then reaches the end position illustrated in FIG. 9 in which the thread guide 9 is so far outside the longitudinal conveyor 11 that the threads of the group of threads 24 can be laid round the pins 25 of the longitudinal conveyor 11. For this purpose, the threads of the group of threads 24 running out of the thread guide 9 below this are picked up by the displacement comb 26 (see FIG. 9) whereupon the displacement comb 26 is displaced in the direction of the arrow shown beside it, counter to the direction of travel of the longitudinal conveyors 10 and 11, into the position illustrated in FIG. 10. At this moment, the longitudinal conveyors 10 and 11 have moved forwards by a whole width of the group of threads 24 in comparison with the initial position illustrated in FIG. 7. For this purpose, the displacement comb 26 is mounted in a slide-like manner on the displacement rail 27. From the position of the displacement comb 26 illustrated in FIG. 10, the weft threads are then transferred in known manner to the longitudinal conveyor 11, in the course of which they become laid round the pins following the pins 25. For reasons of the clarity of the illustration, this transfer is not illustrated in the Figures but it can be seen from the FIGS. 6 to 15 of the DE-OS 20 12 114. After transfer of the weft threads to the longitudinal conveyor 11 has been effected, the carriage 17 with the thread guide 9, moves away from the longitudinal conveyor 11 in the direction of the longitudinal conveyor 10 (the initial phase of this laying being illustrated in FIG. 10), and half way to the longitudinal conveyor 10, the thread guide assuming the position illustrated in FIG. 11. In this case, the longitudinal conveyors 10 and 11 have again moved forwards by half the width of the group of threads 24.

The further travel of the carriage 17 with the thread guide 9 is shown in FIG. 11 from which it can be seen that the thread guide 9, which is changing over from the position shown in FIG. 10 into the position illustrated in FIG. 11, half overlaps the group of threads 24 previously laid, in about the middle of its movement, because of the forward movement of the longitudinal conveyors 10 and 11. Finally, while laying the group of threads 28 in question, the thread guide 9 reaches the position illustrated in FIG. 12 in which the group of threads 28 is picked up by the displacement comb 23 which, in accordance with the operation of the displacement comb 26 (see FIGS. 9 and 10), is displaced in the direction of the arrow shown beside it, counter to the direction of travel of the longitudinal conveyors 10 and 11, into the position illustrated in FIG. 13. At this moment, the longitudinal conveyors 10 and 11 have already moved forwards by twice the width of the group of threads 24 in comparison with the initial position illustrated in FIG. 7. The transfer of the weft threads to the next pins in question of the longitudinal conveyor 10 is then effected as described with reference to FIGS. 9 and 10.

The further movement of the carriage 17 with the thread guide 9 as shown in FIGS. 14 and 15 is then effected, in principle, in the same manner as illustrated with reference to FIGS. 11 and 12 but in the reverse direction, and so on. As shown in FIG. 15, the layer of weft threads laid in this case already consists of the three groups of threads 24, 28 and 29 which are continuously followed by further groups of threads so that altogether a layer of weft threads results in which the individual weft threads lie parallel and with equal spacing.

The laying of three layers of weft threads corresponding to the sequence of layers as shown in FIG. 2 is illustrated in FIG. 16. The carriage 30, which is mounted for displacement on the runway rails 35 and 36 via the rollers 31, 32, 33 and 34, serves to lay the layer 1. In this case, the carriage movement is effected in accordance with the illustration in FIGS. 9 to 15, that is to say perpendicular to the direction of travel 7 of the longitudinal conveyors 10 and 11. Disposed on the carriage 30 for longitudinal adjustment is the thread guide 37 for which purpose it is mounted between the two guide rails 38 and 39 of the carriage 30. Extending above the carriage 30 with the guide rails 38 and 39 is the guide rail 40 with the slot 41 in which the pin 42 is guided on which the thread guide 37 hangs. During the movement of the carriage 30 from the one longitudinal conveyor to the other (from 10 to 11 or vice versa), the thread guide 37 is adjusted in the direction of travel 7 or counter to the direction of travel according to the selected inclined position of the guide rail 40, as a result of which the same inclined position of the groups of threads ultimately laid by the thread guide 37 results. The angle of the guide rail 40 is adjustable so that, with its adjustment, a correspondingly selected inclined position of the weft threads in the layer of weft threads in question results. The length of the path of the carriage is also correspondingly adjustable according to the spacing of the longitudinal conveyors 10 and 11.

Shown diagrammatically in FIG. 16, for each layer 1, 13, 2 of weft threads, at each side of the longitudinal conveyors 10 and 11 are the necessary displacement combs 23 and 26, the operation of which has already been described with reference to FIGS. 7 to 15.

The layer 13 is laid by means of the carriage 43, the thread guide 44 of which is not adapted for adjustment on the carriage 43. Consequently, a layer of transverse weft threads which extend perpendicular to the direction of travel 7 of the longitudinal conveyors 10 and 11 is laid by this thread guide 44.

The layer 2 is laid by means of the carriage 64 and the thread guide 48 in a corresponding manner to the layer 1 but in the opposite inclined position as a result of a corresponding inclined position of the guide rail 45 provided here. Apart from this, the arrangement for laying the layer 2 corresponds completely to that for laying the layer 1 with carriage 30 and thread guide 37.

It may also be pointed out that after the selected adjustment has been effected, the guide rails 40 and 45 are not altered again with regard to their inclined position so that the thread guide in question is always reciprocated over the region between the two longitudinal conveyors 10 and 11 in the same oblique direction.

FIG. 17 illustrates, in a diagrammatic side view, the supply of three layers of transverse weft threads by means of the thread guides 37, 44 and 48, while, in addition, the stationary threads 49 are laid on the layer laid by the thread guide 37 and the stationary threads 50 are laid on the layer laid by the thread guide 44. The conveying of the layers of weft threads thus laid is effected by means of the longitudinal conveyors, not illustrated here, as shown in the Figures described above. In the region of the needle bed 12, the stationary threads 51 and the fleece 52 additionally run in so that inside the goods thus produced, from the bottom upwards, the fleece 52 lies at the lowest position and above it, in succession, the layer of transverse weft threads laid by the thread guide 37, the parallel arrangement of stationary threads 49, the layer of transverse weft threads laid by the thread guide 44, the arrangement of stationary threads 50, the layer of transverse weft threads laid by the thread guide 48 and finally the stationary threads 51. The needle bed consists in known manner of the slide needle 53 with slide 54, the perforated needle 55 for the supply of the warp thread 56, the knock-off sinker 57 and the piercing comb 58.

In FIG. 18, the stitch pattern resulting with the layer formation as shown in FIG. 4 is illustrated. It consists of the transverse weft threads forming the lowest layer 1, the layer 13 situated above it and extending perpendicular to the direction of travel 7, the stationary threads 15, the layer 2 of transverse weft threads and the warp thread 59 which connects the above-mentioned layers 1, 13 and 2 as well as the longitudinal weft threads 15 to one another in jersey stitch.

FIG. 19 shows the whole side view of a warp knitting machine illustrated diagrammatically, with which the types of goods described above can be produced. In this machine, the layers laid in each case are conveyed to the needle bed 12 by means of the longitudinal conveyors 10/11, constructed in the form of circulating chains, the bottom layer being laid by means of the thread guide 37, the second layer by means of the thread guide 44 and the third layer by means of the thread guide 48. These three thread guides are mounted on corresponding carriages in the manner illustrated in FIG. 16 so that in this respect reference can be made to the mode of illustration in FIG. 1. The stationary threads 49, 50 and 51, which are withdrawn from the stationary-thread beam 60 via appropriate guide rollers, are laid on the layers in question. The warp threads needed to knit these layers and stationary threads are delivered from the warp beam 61. Finally, the fleece 52, which is withdrawn from the roll 62, is supplied to the needle bed 12. Thus an article results, the supply of the parts of which is illustrated in FIG. 17. The goods running out of the needle bed 12 are wound on the roll 60.

It may also be pointed out that the combinations of layers of transverse weft threads, stationary threads and incorporated finished goods or fleece, illustrated in the Figures described above may be further varied in themselves in which case the number of layers, the sequence etc. as well as the resulting appearance of the finished goods vary accordingly.

I claim:

1. A weft thread laying apparatus for warp knitting machines having a needle bed and two spaced apart longitudinal conveyors for continuously conveying weft threads in a given direction to the needle bed, the apparatus comprising:

first and second carriages reciprocally movable between said two longitudinal conveyors in a substantially transverse direction to the movement of said conveyors, with said second carriage spaced from said first carriage and located intermediate said needle bed and said first carriage;

first and second thread laying guides carried on said first and second carriages, respectively, and adapted for movement in a direction relative to the direction of movement of said conveyors to lay a first and a second plurality of parallel weft threads between said conveyors;

first and second runway rails cooperating with said first and second thread laying guides, respectively, to guide the same in a given reciprocal path between said opposed conveyors; and first and second guide rails being movable relative to the direction of movment of said conveyors to cause said thread laying guides to lay said plurality of first and second weft threads at an angle of 20° or greater as viewed transversely to the direction of travel of said conveyors;

a pair of displacement combs for each of said first and second thread laying guides, with each comb of said pair located outwardly adjacent each of the opposed conveyors and adapted to pick the plurality of weft threads from said thread laying guide substantially at the location where said thread guide carried by said thread carriage passes over one conveyor, reverse direction, and moves in that angular reciprocal path determined by said rail toward said other conveyor;

each comb of said pair movable in a reciprocable path parallel to said conveyors that distance necessary for said thread guide to lay successive widths of a given plurality of weft threads in parallel onto its respective conveyor;

wherein each of said combs receives a given plurality of parallel weft threads from said thread guide, locates the same on the respective adjacent conveyor and then moves in a direction opposite to that of the conveyor that distance necessary for said thread guide to place a successive width of the given plurality of parallel weft threads onto the conveyor so that all the weft threads of each of said first and second thread guides extend in parallel between said opposed conveyors, said plurality of weft threads from said first second thread guides retained in position thereon until knitted together at the needle bed; and roller guide means carried above said conveyors for laying stationary threads in the direction of travel of the longitudinal conveyors and being introduced over one layer of weft threads.

2. A weft thread laying apparatus for warp knitting machines having a needle bed and two spaced apart longitudinal conveyors for continuously conveying weft threads in a given direction to the needle bed, the apparatus comprising:

first and second carriages reciprocally movable between said two longitudinal conveyors in a substantially transverse direction to the movement of said conveyors, with said second carriage spaced from said first carriage and located intermediate said needle bed and said first carriage;

first and second thread laying guides carried on said first and second carriages, respectively, and adapted for movement in a direction relative to the direction of movement of said conveyors to lay a first and a second plurality of parallel weft threads between said conveyors;

first and second runway rails cooperating with said first and second thread laying guides, respectively, to guide the same in a given reciprocal path between said opposed conveyors; and first and second guide rails being movable relative to the direction of movement of said conveyors to cause said thread laying guides to lay said plurality of first and second weft threads at an angle of 20° or greater as viewed transverely to the direction of travel of said conveyors;

a pair of displacement combs for each of said first and second thread laying guides, with each comb of said pair located outwardly adjacent each of the opposed conveyors and adapted to pick the plurality of weft threads from said thread laying guide substantially at the location where said thread guide carried by said thread carriage passes over one conveyor, reverses direction, and moves in that angular reciprocal path determined by said rail toward said other conveyor;

each comb of said pair movable in a reciprocable path parallel to said conveyors that distance necessary for said thread guide to lay succesive widths of a given plurality of weft threads in parallel onto its respective conveyor;

wherein each of said combs can receive a given plurality of parallel weft threads from said thread guide, locate the same on the respective adjacent conveyor and then move in a direction opposite to that of the conveyor the distance necessary for said thread guide to place a successive width of the given plurality of parallel weft threads onto the conveyor so that all the weft threads of each of said first and second thread guides extend in parallel between said opposed conveyors, said plurality of weft threads from said first and second thread guides retained in position thereon until knitted together at the needle bed; and roller guide means carried above said conveyors for laying stationary threads in the direction of the longitudinal conveyors and being introduced between the two layers of weft threads.

3. A weft thread laying apparatus for warp knitting machines having a needle bed and two spaced apart longitudinal conveyors for continually conveying weft threads in a given direction to the needle bed, said conveyors having means equally spaced therealong for receiving weft threads therearound, the apparatus comprising:

first and second carriages reciprocally movable across the space between said longitudinal conveyors and beyond, each said carrage including a thread laying guide for receiving a plurality of weft threads, said thread guide being parallel to said conveyors, said carriages being movable across said space between said conveyors in a manner to lay said weft threads from said thread guide across said space parallel to and equidistant from each other, and at an angle of at least 20° as viewed transverse to the direction of travel of the conveyors, and to locate said weft threads around said thread receiving means on said conveyor, threads from said first carriage forming a first layer of parallel weft threads and threads from said second carriage forming a second layer of parallel weft threads at a predetermined angle to the threads of said first layer, a displacement comb located outside and adjacent each conveyor to receive the plurality of weft threads from each said thread laying guide after said thread guide carried by said thread carriage passes over said conveyor, and before the carriage reverses direction for return along the reciprocal path across said space between said conveyors;

each said comb having means for moving same in a reciprocable path parallel to said conveyor for a predetermined distance substantially equivalent to the width of said weft threads carried by said thread guide;

said thread guide locating said plurality of parallel weft threads on the respective adjacent thread receiving means on said conveyor and the comb, thereafter the comb moves in a direction opposite to that of the conveyor that distance necessary for said thread guide to place a successive width of the given plurality of parallel weft threads onto adjacent thread receiving means on said conveyor so that all the weft threads of each of said first and second thread guides extend equidistant from each other and in parallel between said opposed conveyors, said layers of weft threads being retained in position by said thread receiving means on said conveyors until knitted together at the needle bed; and roller guide means carried above said conveyors for laying stationary threads in the direction of the longitudinal conveyors and being introduced over one layer of weft threads.

4. A weft thread laying apparatus as claimed in claim 3 wherein one of the two layers extends substantially perpendicularly to the direction of travel of the longitudinal conveyors.

5. A weft thread laying apparatus as claimed in claim 3 wherein both layers cross the direction of travel of the longitudinal conveyors at substantially the same angle.

6. A weft thread laying apparatus as claimed in claim 5 wherein the same angle is at 45°.

7. A weft thread laying apparatus as claimed in claim 3 including a third carriage reciprocally movable across the space between said longitudinal conveyors and including a third laying guide equally spaced between said first and second carriages for laying weft threads as a third layer, the direction of said weft threads in said third layer extending substantially perpendicular to the direction of travel of the longitudinal conveyors and being adapted for substantially forming an angle bisector of the angle formed by the first and second layers.

8. A weft thread laying apparatus as claimed in claim 5 wherein said third layer is layed after the laying of the first layer and before the laying of the second layer.

* * * * *

UNITED STATES PATENT OFFICE

CERTIFICATE OF CORRECTION

Patent No. 4,872,323 Dated October 10, 1989

Inventor(s) Roland WUNNER

It is certified that error appears in the above-identified patent and that said Letters Patent is hereby corrected as shown below:

On the title page, the terminal disclaimer date should be changed from "July 7, 2006" to -- July 7, 2004 --.

Signed and Sealed this

Thirtieth Day of October, 1990

*Attest:*

HARRY F. MANBECK, JR.

*Attesting Officer*

*Commissioner of Patents and Trademarks*